US008438756B2

(12) United States Patent
Kelley

(10) Patent No.: US 8,438,756 B2
(45) Date of Patent: May 14, 2013

(54) ARTICLES OF FOOTWEAR

(75) Inventor: Thomas Jeffrey Kelley, San Diego, CA (US)

(73) Assignee: Deckers Outdoor Corporation, Goleta, CA (US)

( * ) Notice: Subject to any disclaimer, the term of this patent is extended or adjusted under 35 U.S.C. 154(b) by 431 days.

(21) Appl. No.: 12/484,168

(22) Filed: Jun. 12, 2009

(65) Prior Publication Data

US 2010/0313444 A1 Dec. 16, 2010

(51) Int. Cl.
*A43B 3/12* (2006.01)

(52) U.S. Cl.
USPC ..... 36/11.5; 36/100; 36/2 R; 36/109

(58) Field of Classification Search ..... 36/100, 36/101, 94, 11.5, 106, 1.5, 2 R, 109, 50.1, 36/88, 91, 92
See application file for complete search history.

(56) References Cited

U.S. PATENT DOCUMENTS

| | | | | | |
|---|---|---|---|---|---|
| 48,897 | A | | 7/1865 | Blodgett | |
| 1,349,095 | A | * | 8/1920 | Parisi | 602/30 |
| 1,368,771 | A | * | 2/1921 | Tweedie | 36/2 R |
| 1,435,047 | A | | 11/1922 | Blum | |
| 1,527,688 | A | | 2/1925 | Lethhern | |
| 1,564,056 | A | * | 12/1925 | Friedman et al. | 36/2 R |
| 1,613,885 | A | * | 1/1927 | Gray | 36/2 R |
| 1,730,400 | A | | 10/1929 | Wharton | |
| 1,831,045 | A | * | 11/1931 | Sundback | 36/2 R |
| D102,345 | S | * | 12/1936 | Stein | D2/931 |
| 2,236,367 | A | * | 3/1941 | Gruber | 36/101 |
| 2,491,297 | A | * | 12/1949 | Brown | 36/94 |
| 3,605,122 | A | | 9/1971 | Myers | |
| 4,314,412 | A | * | 2/1982 | Anderson et al. | 36/100 |
| 4,344,189 | A | * | 8/1982 | Futere et al. | 2/16 |
| 4,599,812 | A | | 7/1986 | Harmsen | |
| D352,153 | S | | 11/1994 | Luque | |
| D361,423 | S | | 8/1995 | Luque | |
| 5,822,888 | A | * | 10/1998 | Terry | 36/100 |
| 5,867,838 | A | | 2/1999 | Corry | |
| 6,117,098 | A | | 9/2000 | Weber et al. | |
| 6,128,834 | A | * | 10/2000 | Vecchiola et al. | 36/11.5 |
| D440,030 | S | | 4/2001 | Revis | |
| 6,226,800 | B1 | | 5/2001 | Islar | |
| D450,177 | S | | 11/2001 | Boncutter | |
| D451,663 | S | | 12/2001 | Haas | |
| D470,648 | S | | 2/2003 | Jacobs | |
| D505,777 | S | | 6/2005 | Dunlap | |

(Continued)

*Primary Examiner* — Marie Patterson
(74) *Attorney, Agent, or Firm* — Greer, Burns & Crain, Ltd.

(57) ABSTRACT

Articles of footwear that include a flexible or rigid sole portion with a shape and size as to correspond to a foot of a wearer, a sole portion having a periphery, a toe region in the front area of the sole portion, a heel region in the back area of the sole portion, and an instep region between the toe and heel regions. Also included is an upper portion connected to the sole portion to form a partially open enclosure for receiving and containing a part of the foot of the wearer and a flexible tubular sleeve which is attached to the sole portion's instep region. The flexible sleeve includes an attachment portion for attaching the flexible sleeve to the instep region of the sole portion, an outwardly opened toe portion for containing the front part of the foot and the toes of the wearer, an outwardly opened heel portion for containing the back part of the foot and the heel of the wearer, and an insertion portion for enveloping the ankle of the wearer.

21 Claims, 5 Drawing Sheets

U.S. PATENT DOCUMENTS

| | | | | |
|---|---|---|---|---|
| 7,022,096 | B1 | 4/2006 | Alfieri | |
| 7,028,420 | B2 * | 4/2006 | Tonkel | 36/100 |
| 7,134,225 | B2 * | 11/2006 | Ashton | 36/94 |
| 7,222,442 | B2 * | 5/2007 | Hillyer et al. | 36/11.5 |
| 7,328,527 | B2 * | 2/2008 | Goldman | 36/100 |
| D576,389 | S | 9/2008 | del Biondi et al. | |
| D578,279 | S | 10/2008 | del Biondi et al. | |
| D661,875 | S | 6/2012 | Kelley | |
| 2011/0078919 | A1 * | 4/2011 | Yang | 36/1.5 |

* cited by examiner

ARTICLES OF FOOTWEAR

CROSS-REFERENCES TO OTHER RELATED PATENT APPLICATIONS

This application relates to the following commonly owned design patent application: "FOOTWEAR." Ser. application No. 29/338,552, filed Jun. 12, 2009, now U.S. Design Patent No. D661,875.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISK APPENDIX

Not Applicable.

BACKGROUND

Embodiments of the claimed subject matter relates to articles of footwear and more particularly to articles of footwear such as sandals.

SUMMARY

According to one embodiment, an article of footwear is provided. The article of footwear includes a flexible or rigid sole portion having the shape and size as to correspond to a foot of a wearer, the sole portion having a periphery, a toe region in the front area of the sole portion, a heel region in the back area of the sole portion, and an instep region between the toe and heel regions, an upper portion connected to the sole portion to form a partially open enclosure for receiving and containing a part of the foot of the wearer, and a flexible tubular sleeve attached to the instep region of the sole portion, wherein the flexible sleeve includes an attachment portion for attaching the flexible sleeve to the instep region of the sole portion, an outwardly opened toe portion for containing the front part of the foot and the toes of the wearer, an outwardly opened heel portion for containing the back part of the foot and the heel of the wearer, and an insertion portion for enveloping the ankle of the wearer.

According to another embodiment, an article of footwear has a sole portion which is flexible and which is made of a material selected from the group consisting of one or more of the following: leather, rubber, plastic, PU, EVA, PVC and any material commonly used in the making of footwear.

According to yet another embodiment, a method of wearing an article of footwear is provided, the method comprising inserting the foot of the wearer into the insertion portion of the flexible tubular sleeve; upwardly moving the flexible tubular sleeve until the insertion portion of the flexible tubular sleeve has enveloped the ankle of the wearer and the toes of the wearer are protruding through the opened toe portion of the flexible tubular sleeve; adjusting the flexible tubular sleeve to align the heel of the wearer with the opened heel portion of the flexible tubular sleeve; and positioning the toes of the wearer so that the toe element is inserted between the hallux and the second toe of the wearer.

According to yet another embodiment a method for fabricating an article of footwear is provided, the method comprising joining together a flexible or rigid sole portion of the article of footwear, an upper portion of the article of footwear, and flexible tubular sleeve to form the article of footwear thereby, wherein the flexible or rigid sole portion has the shape and size as to correspond to a foot of a wearer, the sole portion having a periphery, a toe region in the front area of the sole portion, a heel region in the back area of the sole portion, and an instep region between the toe and heel regions; the combination of the upper portion connected to the sole portion forms a partially open enclosure for receiving and containing a part of the foot of the wearer; and the flexible tubular sleeve is attached to the instep region of the sole portion, wherein the flexible sleeve comprises an attachment portion for attaching the flexible sleeve to the instep region of the sole portion, an outwardly opened toe portion for containing the front part of the foot and the toes of the wearer, an outwardly opened heel portion for containing the back part of the foot and the heel of the wearer, and an insertion portion for enveloping the ankle of the wearer. Other embodiments include articles of footwear with a removably attachable flexible tubular sleeve that can be attached or removed from the instep region.

BRIEF DESCRIPTION OF THE DRAWINGS

The features of the invention will be better understood by reference to the accompanying drawings which illustrate presently preferred embodiments of the invention. In the drawings.

DETAILED DESCRIPTION OF THE EMBODIMENTS

Figure 1:
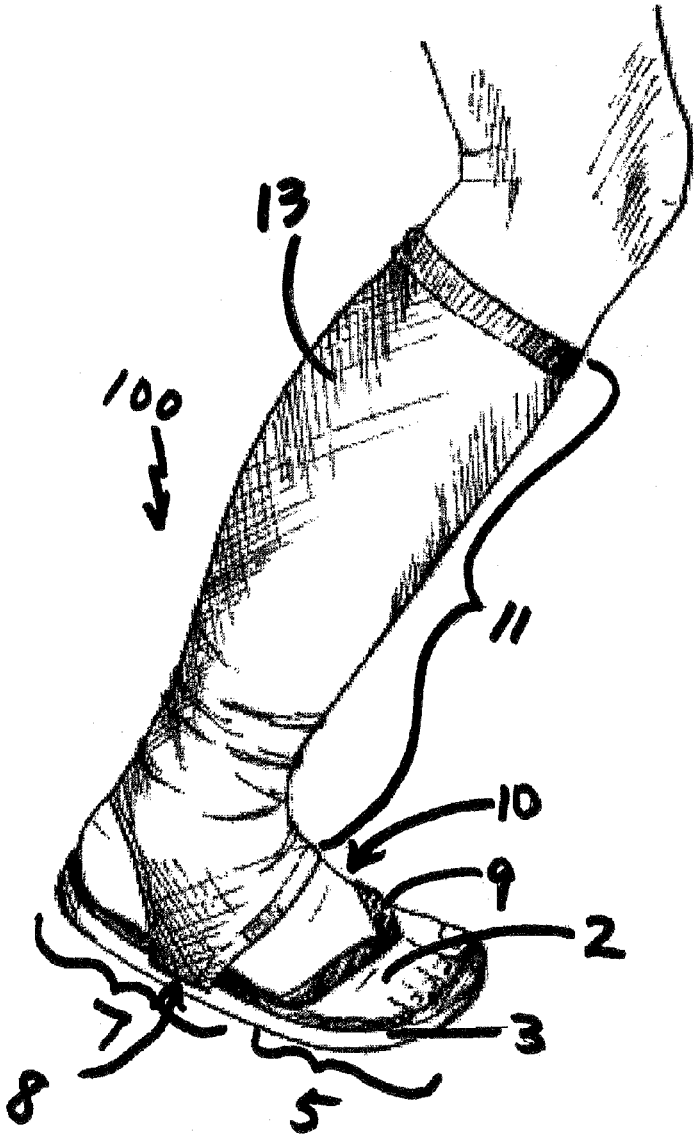
FIG. 1 depicts schematically a side view of an article of footwear according to an embodiment of the claimed subject matter.
Figure 2:
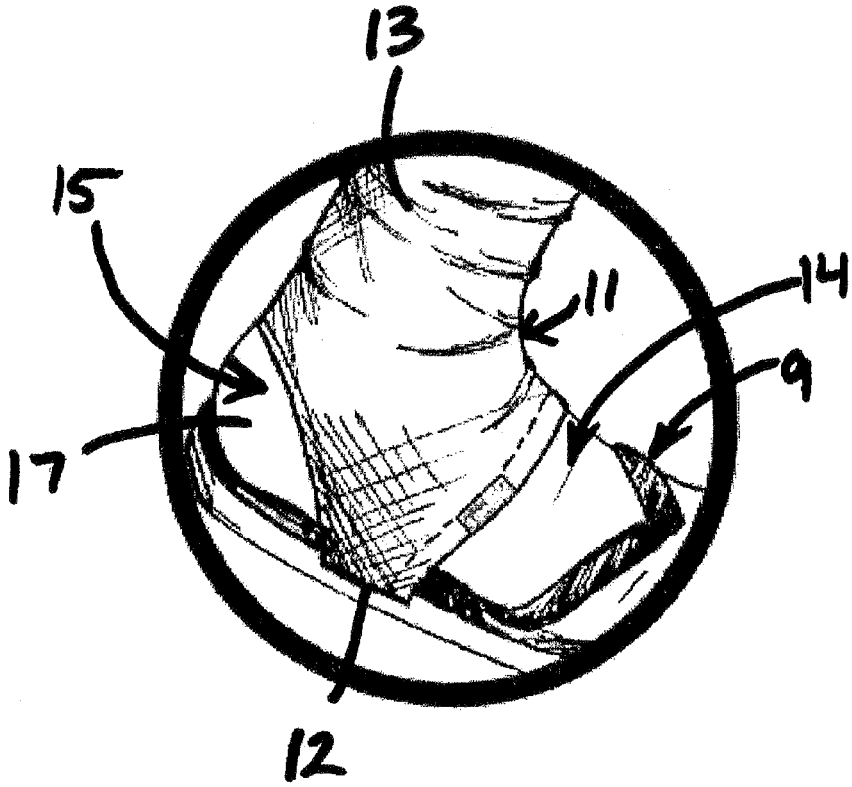
FIG. 2 depicts schematically another view of an article of footwear according to an embodiment of the claimed subject matter.
Figure 3:
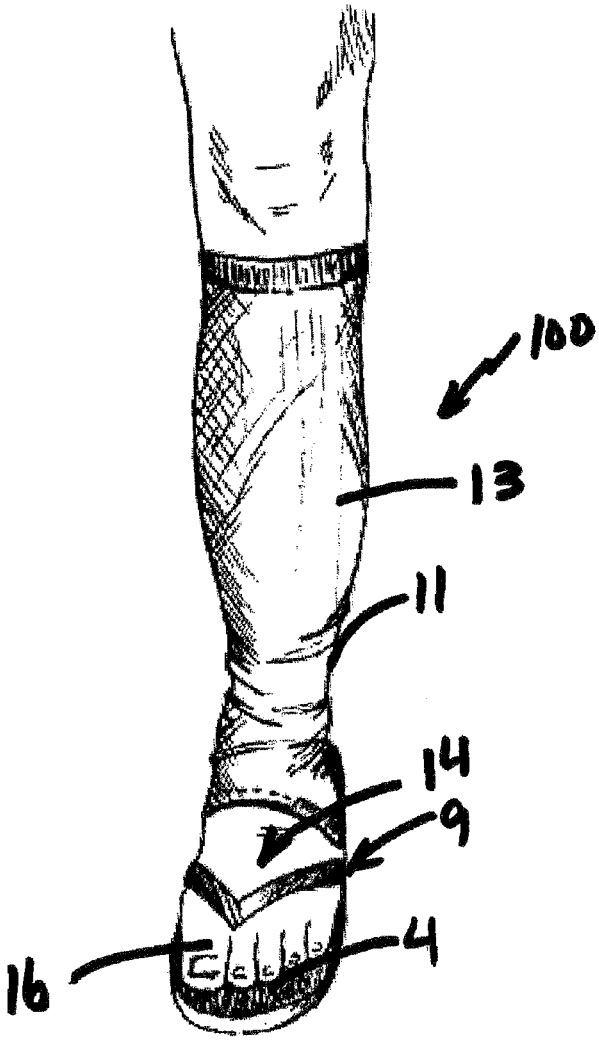
FIG. 3 depicts schematically yet another view of an article of footwear according to an embodiment of the claimed subject matter.

With reference now to the various figures in which identical elements are numbered identically throughout, a description of various exemplary aspects of the present inventive subject matter will now be provided.

Referring now to FIGS. 1-5, various views of embodiments of an article of footwear 100 are shown. The article of footwear 100 includes a flexible or rigid sole portion 1 having the shape and size as to correspond to a foot 2 of a wearer. The sole portion 1 has a periphery 3, a toe region 4 in the front area 5 of the sole portion 1, a heel region 6 in the back area 7 of the sole portion 1, and an instep region 8 between the toe and heel regions 4 and 6.

The article of footwear 100 further includes an upper portion 9 connected to the sole portion 1 thus forming a partially open enclosure 10 for receiving and containing a part of the foot 2 of the wearer, and a flexible tubular sleeve 11 attached to the instep region 8 of the sole portion 1. The sole portion 1 may be fabricated of a single layer of a material or may comprise a plurality of layers assembled together. The upper portion 9 may be attached to the sole portion 1 by any suitable means, such as stitching, gluing and using a mechanical attachment such as via attaching the upper portion 9 to apertures in the sole portion 1 which receive one or more ends of the upper portion 9, or any combination of the aforementioned.

The flexible tubular sleeve 11 may be attached to the instep region 8 of the sole portion 1 in a variety of ways. In some embodiments, the flexible tubular sleeve 11 is attached to the instep region 8 of the sole portion 1 via a channel within the instep region 8 so that the flexible tubular sleeve 11 is moveable within the channel. In other embodiments, the attachment of the flexible tubular sleeve 11 may be accomplished by inserting the attachment portion of the flexible sleeve 11 between two adjacent layers of the sole portion 1. In yet other embodiments, the flexible tubular sleeve 11 may be attached to the instep region 8 of to the sole portion 1 by stitching or by gluing or by using a mechanical attachment such as via attaching of the upper portion 9 to apertures in the sole portion 1 which receive one or more ends of the upper portion 9, or any combination of the aforementioned.

In some embodiments, the flexible sleeve 11 further includes an attachment portion 12 for attaching the flexible sleeve 11 to the instep region 8 of the sole portion, and an insertion portion 13 for enveloping the ankle of the wearer. In several embodiments, the attachment portion 12 is removably attachable. Finally, the flexible sleeve 11 further includes two outwardly opened portions 14 and 15: an outwardly opened toe portion 14 for containing the front part of the foot 2 and the toes 16 of the wearer, and an outwardly opened heel portion 15 for containing the back part of the foot 2 and the heel 17 of the wearer.

As mentioned above, the sole portion 1 may be flexible, in which case it may be made of a material selected from the group consisting of one or more of the following: leather, rubber, plastic, PU, EVA, PVC and any material commonly used in the making of footwear. If a rigid sole portion 1 is used, it may be fabricated of a material selected from the group consisting of one or more of the following: leather, a woven fabric, cotton, wool, rubber, EVA, PU, and PVC.

The above-mentioned upper portion 9 may be flexible and may be fabricated of a material selected from the group consisting of one or more of the following: leather, rubber, plastic, PU, EVA, PVC, fabric any other material commonly used in the making of footwear. Turning now to the elements of the upper portion 9, it further comprises a toe element 18 and two arch elements 19. The toe element 18 is intended for insertion between the hallux and the second toe of the wearer.

Figure 5:
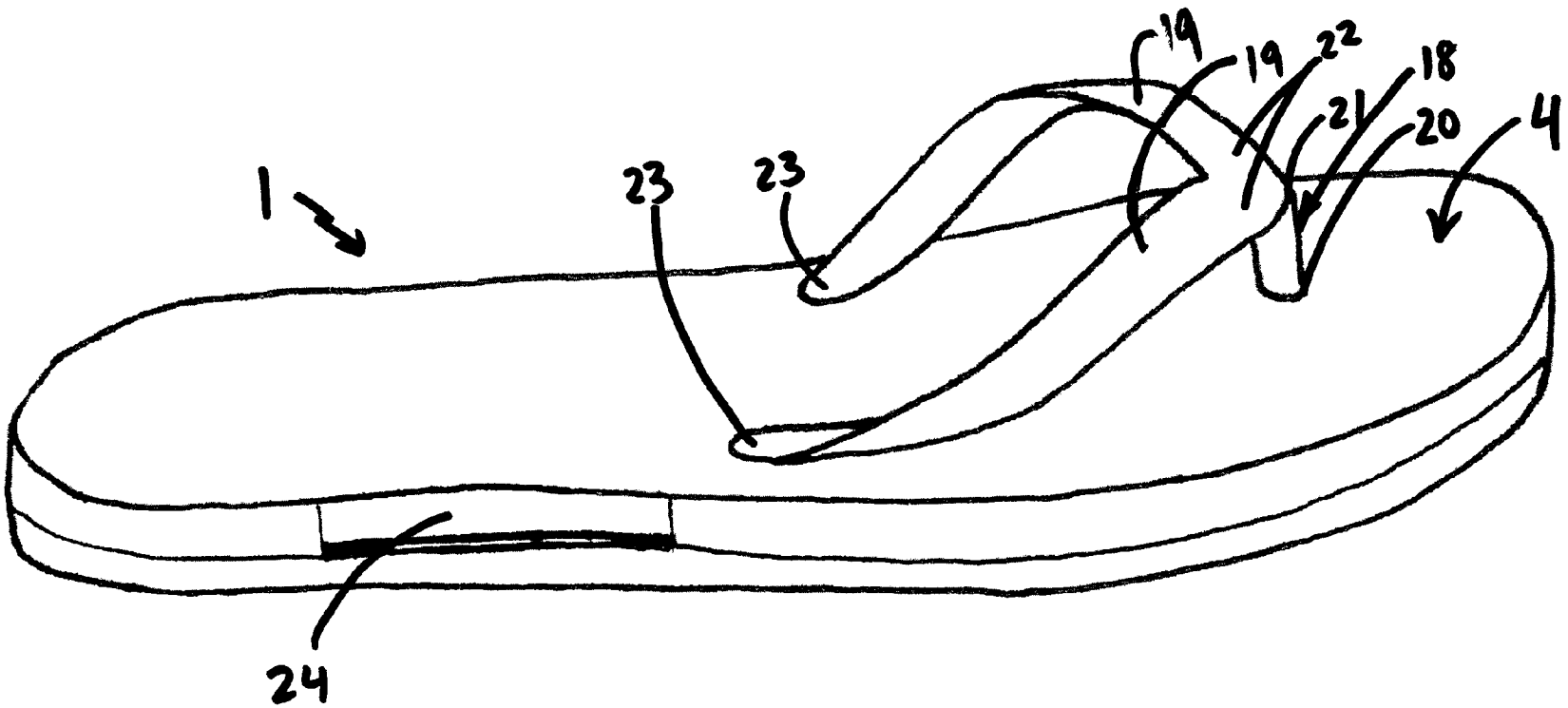
FIG. 5 depicts schematically a side perspective view of the sole portion including a channel and the upper portion of an article of footwear according to an embodiment of the claimed subject matter.

As can be seen from FIG. 5, the toe element 18 extends outwardly from the sole portion 1 and includes the first end 20 and the second end 21. The first end 20 is attached to the toe region 4 of the sole portion 1. Each of the two arch elements 19 has the toe end 22 and the periphery end 23. Each of the toe ends 22 of the arch elements 19 is attached to the second end 21 of the toe element 18, and each of the periphery ends 23 is attached to the periphery of the sole portion 1.

Figure 4:
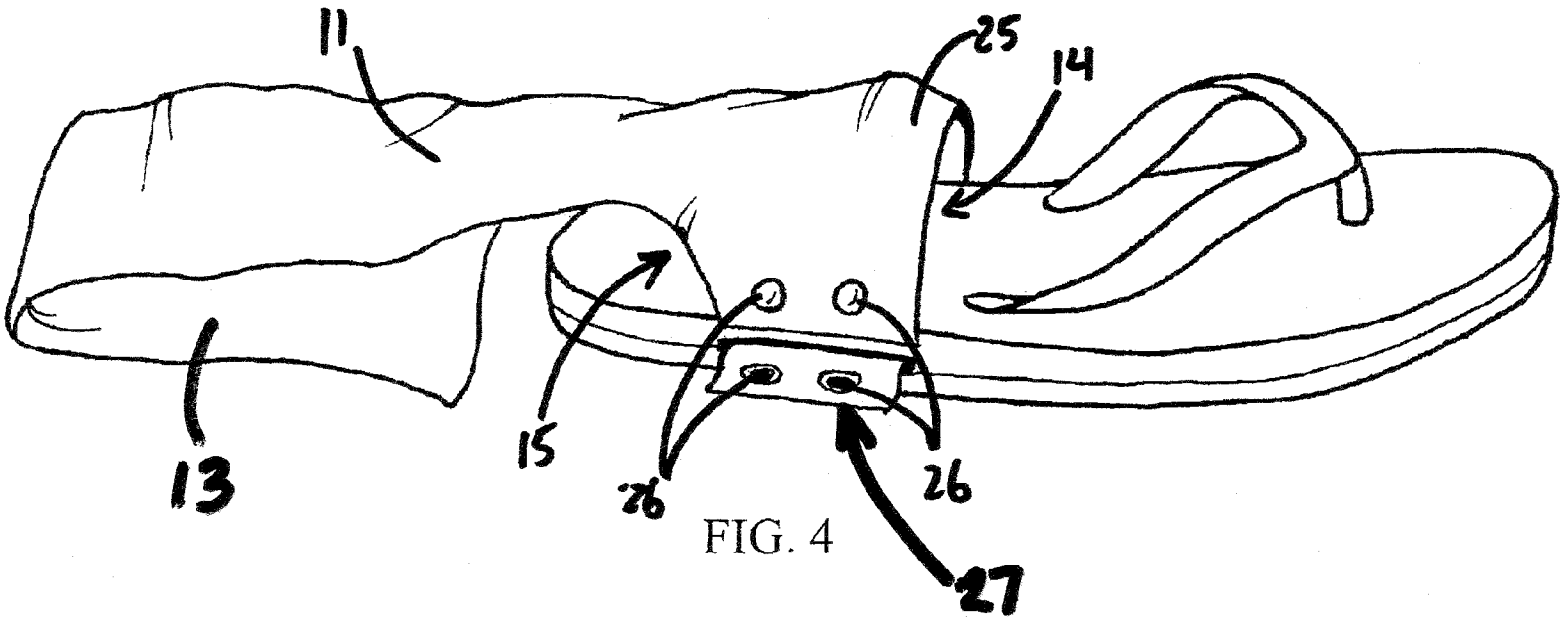
FIG. 4 depicts schematically a perspective view of the flexible tubular sleeve including a semi-circular element of an embodiment of the claimed subject matter.

In some embodiments, the flexible tubular sleeve 11 may further comprise a semi-circular element 25 as shown in FIG. 4. This semi-circular element 25 shown has two ends 27. In other embodiments, more ends may be used. Each end of the semi-circular element 25 may be attached to the opposing sides of the periphery of the sole portion 1 or the ends may be fastened together as shown in FIG. 4 with two snap fasteners 26. FIG. 4 shows one end across the top of sole portion 1 and one end positioned within channel 24 of sole portion 1.

In several embodiments, the semi-circular element 25 may have one or more ends 27 that are positioned within the channel 24 of sole portion 1 shown in FIG. 5.

The above-described flexible sleeve 11 may be fabricated of a material selected from the group consisting of one or more of the following: leather, a woven fabric, cotton, wool, rubber, lycra, and elastic.

The specific sizes and other parameters of the article of footwear 100 may vary depending on design options, manufacturing requirements and other factors. Those having ordinary skill in the art will be able to select these parameters as desired. In some exemplary embodiments, the width of the attachment portion 12 of the flexible tubular sleeve 11 may be about the same as width of the arch of a wearer's foot 2, and can be, for example, between about two and about eight centimeters. In other embodiments, the attachment portion 12 may be larger than eight centimeters and in other embodiments, the attachment portion 12 may be smaller than two centimeters.

Further embodiments of the claimed subject matter provide for methods of wearing the above-described article of footwear 100. One method includes the following steps. First, the wearer inserts his or her foot 2 into the insertion portion 13 of the flexible tubular sleeve 11. Next, the wearer upwardly moves the flexible tubular sleeve 11 until the insertion portion 13 of the flexible tubular sleeve 11 has enveloped the ankle of the wearer and the toes 16 of the wearer are protruding through the opened toe portion 14 of the flexible tubular sleeve 11.

Next, the wearer adjusts the flexible tubular sleeve 11 to align the heel 17 of the wearer with the opened heel portion 15 of the flexible tubular sleeve. Finally, the toes 16 of the wearer are positioned in such a way that the toe element 18 is inserted between the hallux and the second toe of the wearer.

There exists a variety of ways suitable for manufacturing the embodiments of the articles of footwear 100. In one exemplary, but non-limiting embodiment, the sole portion 1 may be joined together with the upper portion 9, and flexible tubular sleeve 11, for example, by stitching, gluing or another suitable method. As a result, the article of footwear 100 described above is formed thereby.

Although the foregoing embodiments have been described in some detail by way of illustration and example for purposes of clarity and understanding, it will be apparent to those of ordinary skill in the art in light of the teaching of this written specification and figures that certain changes and modifications may be made thereto without departing from the spirit or scope of the claimed subject matter.

What is claimed is:

1. An article of footwear, comprising:

(a) a flexible or rigid sole portion having the shape and size as to correspond to a foot of a wearer, the sole portion having:
  (i) a periphery;
  (ii) a toe region in the front area of the sole portion;
  (iii) a heel region in the back area of the sole portion; and
  (iv) an instep region between the toe and heel regions;

(b) an upper portion connected to the sole portion to form a partially open enclosure for receiving and containing a part of the foot of the wearer; and (c) a flexible tubular sleeve spaced from the upper portion and attached to the instep region of the sole portion, wherein the flexible sleeve comprises:
  (i) an attachment portion for attaching the flexible sleeve to the instep region of the sole portion;
  (ii) an outwardly opened front portion;
  (iii) an outwardly opened heel portion; and
  (iv) an insertion portion extending above the upper portion for enveloping the ankle of the wearer.

2. The article of footwear according to claim 1, wherein the sole portion is flexible and is made of a material selected from the group consisting of one or more of the following: leather, rubber, plastic, PU, EVA, and PVC.

3. The article of footwear according to claim 1, wherein the sole portion is rigid and is made of a material selected from the group consisting of one or more of the following: leather, a woven fabric, cotton, wool, rubber, EVA, PU, and PVC.

4. The article of footwear according to claim 1, wherein the upper portion further comprises:

(a) a toe element for insertion between the hallux and the second toe of the wearer, the toe element extending outwardly from the sole portion and including the first end and the second end, the first end being attached to the toe region of the sole portion; and (b) two arch elements, each having the toe end and the periphery end, wherein each of the toe ends of the arch elements is attached to the second end of the toe element, and each of the periphery ends is attached to the periphery of the sole portion.

5. The article of footwear according to claim 4, wherein the upper portion is flexible and is made of a material selected from the group consisting of one or more of the following: leather, rubber, plastic, PU, EVA, PVC, and fabric.

6. The article of footwear according to claim 1, wherein the attachment portion of the tubular sleeve further comprises a semi-circular element having two ends, wherein each end of the semi-circular element is attached to the opposing sides of the periphery of the sole portion.

7. The article of footwear according to claim 1, wherein the upper portion is attached to the sole portion by stitching or by gluing.

8. The article of footwear according to claim 1, wherein the flexible tubular sleeve is made of a material selected from the group consisting of one or more of the following: leather, a woven fabric, cotton, wool, rubber, lycra, and elastic.

9. The article of footwear according to claim 1, wherein the sole portion comprises a plurality of layers assembled together.

10. The article of footwear according to claim 8, wherein the flexible tubular sleeve is attached to the instep region of to the sole portion by inserting the attachment portion of the flexible sleeve between two adjacent layers of the sole portion.

11. The article of footwear according to claim 1, wherein the flexible tubular sleeve is attached to the instep region of to the sole portion by stitching or by gluing.

12. The article of footwear according to claim 1, wherein the flexible tubular sleeve is removably attached to the instep region.

13. The article of footwear according to claim 1, wherein the flexible tubular sleeve is attached to the instep region of to the sole portion via a channel within said instep region so that said sleeve is moveable within said channel.

14. The article of footwear according to claim 1, wherein the width of the attachment portion of the flexible tubular sleeve is between about two and about eight centimeters.

15. The article of footwear according to claim 13, wherein the width of the attachment portion of the flexible tubular sleeve is between two and sixteen centimeters.

16. A method of wearing an article of footwear according to claim 4, the method comprising:

(a) inserting the foot of the wearer into the insertion portion of the flexible tubular sleeve;

(b) upwardly moving the flexible tubular sleeve until the insertion portion of the flexible tubular sleeve has enveloped the ankle of the wearer and the toes of the wearer are protruding through the opened toe portion of the flexible tubular sleeve;

(c) adjusting the flexible tubular sleeve to align the heel of the wearer with the opened heel portion of the flexible tubular sleeve; and (d) positioning the toes of the wearer so that the toe element is inserted between the hallux and the second toe of the wearer.

17. A method for fabricating an article of footwear, comprising joining together a flexible or rigid sole portion of the article of footwear, an upper portion of the article of footwear, and flexible tubular sleeve to form the article of footwear thereby, wherein:

(a) the flexible or rigid sole portion has the shape and size as to correspond to a foot of a wearer, the sole portion having:

(i) a periphery;

(ii) a toe region in the front area of the sole portion;

(iii) a heel region in the back area of the sole portion; and (iv) an instep region between the toe and heel regions;

(b) the combination of the upper portion connected to the sole portion forms a partially open enclosure for receiving and containing a part of the foot of the wearer; and (c) the flexible tubular sleeve is spaced from the upper portion and attached to the instep region of the sole portion, wherein the flexible sleeve comprises:

(v) an attachment portion for attaching the flexible sleeve to the instep region of the sole portion;

(vi) an outwardly opened front portion;

(vii) an outwardly opened heel portion; and (viii) an insertion portion extending above the upper portion for enveloping the ankle of the wearer.

18. An article of footwear, comprising:

(a) a sole defining opposing channels extending through at least a portion of said sole;

(b) an upper connected to the sole; and (c) a flexible tubular sleeve spaced from the upper and attached to the sole, said sleeve including:

(i) an attachment portion including opposing ends, each of said ends being inserted through a respective one of said channels and removably attached to said sole; and (ii) an insertion portion extending from said attachment portion and above the upper to envelope an ankle of a wearer.

19. The article of footwear of claim 18, wherein said sleeve further includes an outwardly opened toe portion.

20. The article of footwear according to claim 18, wherein the flexible tubular sleeve further comprises a semi-circular element having said opposing ends, wherein each end of the semi-circular element is attached to opposing sides of the sole.

21. An article of footwear, comprising:

(a) a sole;

(b) an upper connected to the sole; and (c) a flexible tubular sleeve spaced from the upper and attached to the sole, said sleeve including:

(i) an attachment portion removably attached to said sole; and (ii) an insertion portion extending from said attachment portion and above the upper, said insertion portion configured to envelope an ankle of a wearer.

* * * * *